US011952178B1

(12) United States Patent
Gardner

(10) Patent No.: US 11,952,178 B1
(45) Date of Patent: Apr. 9, 2024

(54) WINE BOTTLE CLOSURE AND OPENER DEVICE

(71) Applicant: Gardner Technologies, LLC, Napa, CA (US)

(72) Inventor: William A. Gardner, Napa, CA (US)

(73) Assignee: Gardner Technologies, LLC, Napa, CA (US)

( * ) Notice: Subject to any disclaimer, the term of this patent is extended or adjusted under 35 U.S.C. 154(b) by 0 days.

(21) Appl. No.: 18/205,547

(22) Filed: Jun. 4, 2023

(51) Int. Cl.
*B65D 41/62* (2006.01)
*B65D 39/00* (2006.01)
*B65D 41/04* (2006.01)

(52) U.S. Cl.
CPC ..... *B65D 41/62* (2013.01); *B65D 39/0011* (2013.01); *B65D 41/0435* (2013.01)

(58) Field of Classification Search
CPC . B65D 41/62; B65D 39/0011; B65D 41/0435
See application file for complete search history.

(56) References Cited

U.S. PATENT DOCUMENTS

| | | | | |
|---|---|---|---|---|
| 6,510,957 | B2 | 1/2003 | Gilley et al. | |
| 6,763,961 | B2 | 7/2004 | Gardner et al. | |
| 2004/0232101 | A1* | 11/2004 | Gardner | B65D 39/0011 215/277 |
| 2005/0247662 | A1* | 11/2005 | Esmond | B65D 51/18 215/320 |
| 2011/0036839 | A1 | 2/2011 | Gardner | |
| 2015/0060389 | A1* | 3/2015 | Bolger | B65D 41/045 215/355 |

* cited by examiner

*Primary Examiner* — Shawn M Braden
(74) *Attorney, Agent, or Firm* — Christopher Pilling

(57) ABSTRACT

A bottle closure and opener device for use on a wine bottle including a sleeve having a top side, a bottom side, an outer surface, and an inner surface, the top side having a first opening, the bottom side having a second opening, and the inner surface including inner threads, wherein the internal threads are configured to mate with external threads on a top portion of the wine bottle. A cork having an upper portion positioned within the first opening of the sleeve and extending above the bottle top and a lower portion of the cork positioned within the wine bottle's neck opening to seal a liquid within the wine bottle and to seal oxygen from entering the bottle. During operation, the cork and sleeve combination are configured to be removed from the wine bottle's opening via unscrewing the sleeve from the top portion of the wine bottle.

7 Claims, 17 Drawing Sheets

WINE BOTTLE CLOSURE AND OPENER DEVICE

CROSS-REFERENCE TO RELATED APPLICATIONS

N/A

BACKGROUND OF THE INVENTION

1. Field of the Invention

The present invention relates to packaging products but more particularly a wine bottle closure and opener device.

2. Description of Related Art

Advancement in the wine packaging industry is difficult because tradition is highly valued. Thus, there has been limited innovation and a lack of widespread adoption. One innovation is a screw cap, which includes a metal cap that screws onto threads on the neck of a wine bottle. However, some believe this type of closure system is not appropriate for high-end or age-worthy wines. Consequently, there is room for improvement in this field. The present invention attempts to provide the right balance between innovation in functionality and retention of traditional cork.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

It is a particular object of the invention to provide an innovative product that is respectful of wine traditions, including both stopper types and visual appearance of the bottle/closure package. It is another object of the invention to provide a device that applies to both still and sparkling wine. It is yet another object of the invention to be used without tools, including, but not limited to, cutting devices and corkscrews.

In order to do this, in one aspect of the invention, a bottle closure and opener device for use on a wine bottle is provided, comprising a sleeve having a top side, a bottom side, an outer surface, and an inner surface, the top side having a first opening, the bottom side having a second opening, and the inner surface including inner threads, wherein the inner threads are configured to mate with external threads on a top portion of the wine bottle; a cork positioned within the first opening of the sleeve and positioned within the wine bottle's opening to seal a liquid within the wine bottle; a cap enclosing a portion of the cork and engaged with an upper portion of the sleeve; and, wherein the cork is configured to be removed from the wine bottle's opening by unscrewing the sleeve from the top portion of the wine bottle.

In one embodiment, the cap is a resealing cap having female threads configured to mate with the external threads on the top portion of the wine bottle such that the wine bottle may be resealed. In one embodiment, the second opening of the sleeve is configured to receive the top portion of the wine bottle enabling the sleeve to encompass the wine bottle's neck. In one embodiment, the cork includes a flange portion configured to sit atop the top side of the sleeve. In one embodiment, the cork is constructed from a natural or synthetic material. In one embodiment, the sleeve is constructed from a high-strength polymer or aluminum. In one embodiment, the liquid within the wine bottle is still or sparkling wine.

In another aspect of the invention, a bottle closure and opener device for use on a wine bottle containing sparkling wine is provided, the device comprising a sleeve having a top side, a bottom side, an outer surface, and an inner surface, the top side having a first opening, the bottom side having a second opening, and the inner surface including inner threads, wherein the inner threads are configured to mate with external threads on a top portion of the wine bottle; a cork positioned within the first opening of the sleeve and positioned within the wine bottle's opening to seal the sparkling wine within the wine bottle; and, wherein the cork is configured to be removed from the wine bottle's opening by unscrewing the sleeve from the top portion of the wine bottle and the pressure is released from within the wine bottle prior to the sleeve being fully unscrewed from the top portion of the wine bottle preventing the cork from an explosive exit.

In one embodiment, a wirehood connected to the sleeve and encompassing the cork is provided. In one embodiment, the wirehood is not removed prior to unscrewing the sleeve from the top portion of the wine bottle. In one embodiment, the inner threads include a thread gap separating the inner threads into upper threads and lower threads, wherein the thread gap produces a cork pop sound when unscrewing the sleeve from the top portion of the wine bottle.

In another aspect of the invention, a bottle closure and opener device for use on a wine bottle is provided, comprising a sleeve having an opening forming a circumferential lip, an inner surface having inner threads, wherein the inner threads are configured to mate with external threads on a top portion of the wine bottle, and the circumferential lip resting on a top surface of the wine bottle's opening; a cork positioned within the opening of the sleeve and positioned within the wine bottle's opening to seal a liquid within the wine bottle, the cork including a cork bulb; and, wherein the cork is configured to be partially removed from the wine bottle's opening via the circumferential lip by unscrewing the sleeve from the top portion of the wine bottle a first distance, and the cork is configured to be fully removed from the wine bottle's opening by an upward pulling motion from a user gripping the sleeve and cork bulb combination.

In one embodiment, the first distance is approximately 4 mm. In another embodiment, the cork has a diameter that varies with axial location, such that an upper portion of the cork has a larger diameter than a lower portion of the cork. In one embodiment, the upper portion of the cork is adjacent and just below the cork bulb. In one embodiment, the sleeve includes a skirt extending downwardly from the inner threads. In one embodiment, the wine bottle is a standard screw cap wine bottle.

The foregoing has outlined rather broadly the more pertinent and important features of the present disclosure so that the detailed description of the invention that follows may be better understood and so that the present contribution to the art can be more fully appreciated. Additional features of the invention, which will be described hereinafter, form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE INVENTION

Figure 1:
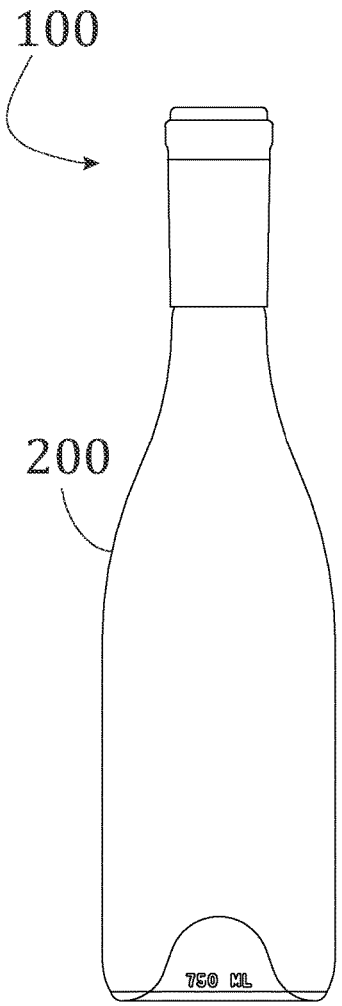
FIG. 1 is a front perspective view of a wine bottle closure and opener device according to an embodiment of the present invention.
Figure 2:
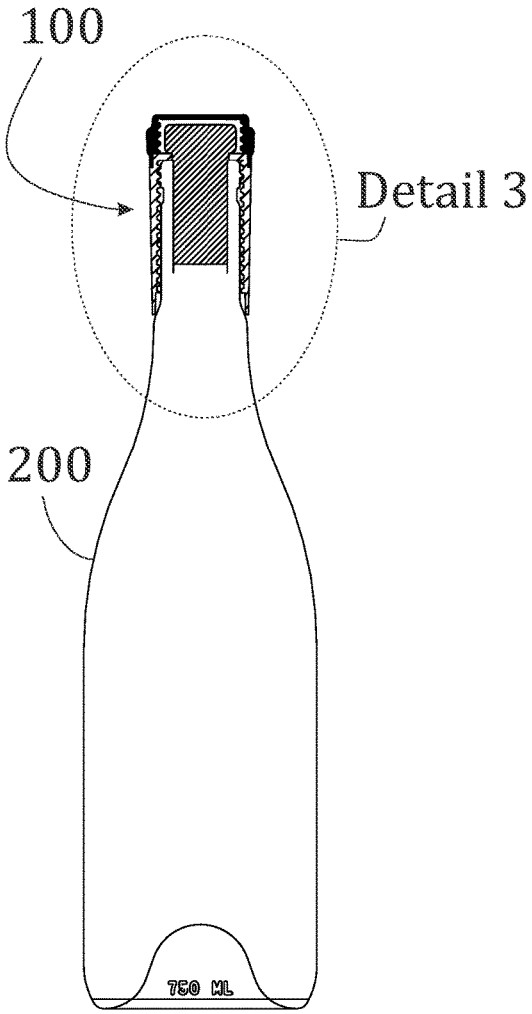
FIG. 2 is a sectional view of FIG. 1.
Figure 3:
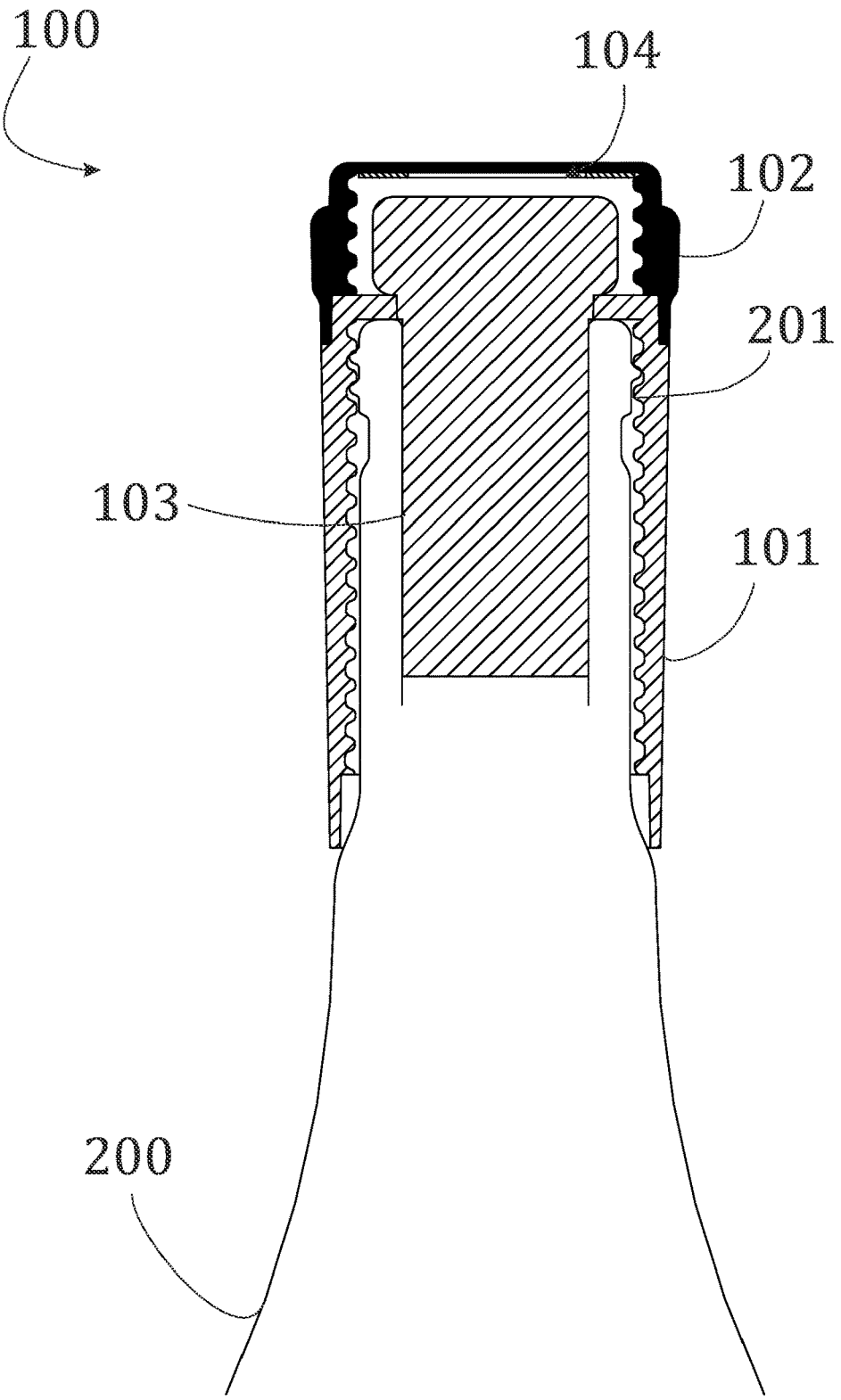
FIG. 3 is a detailed view of FIG. 2.
Figure 4:
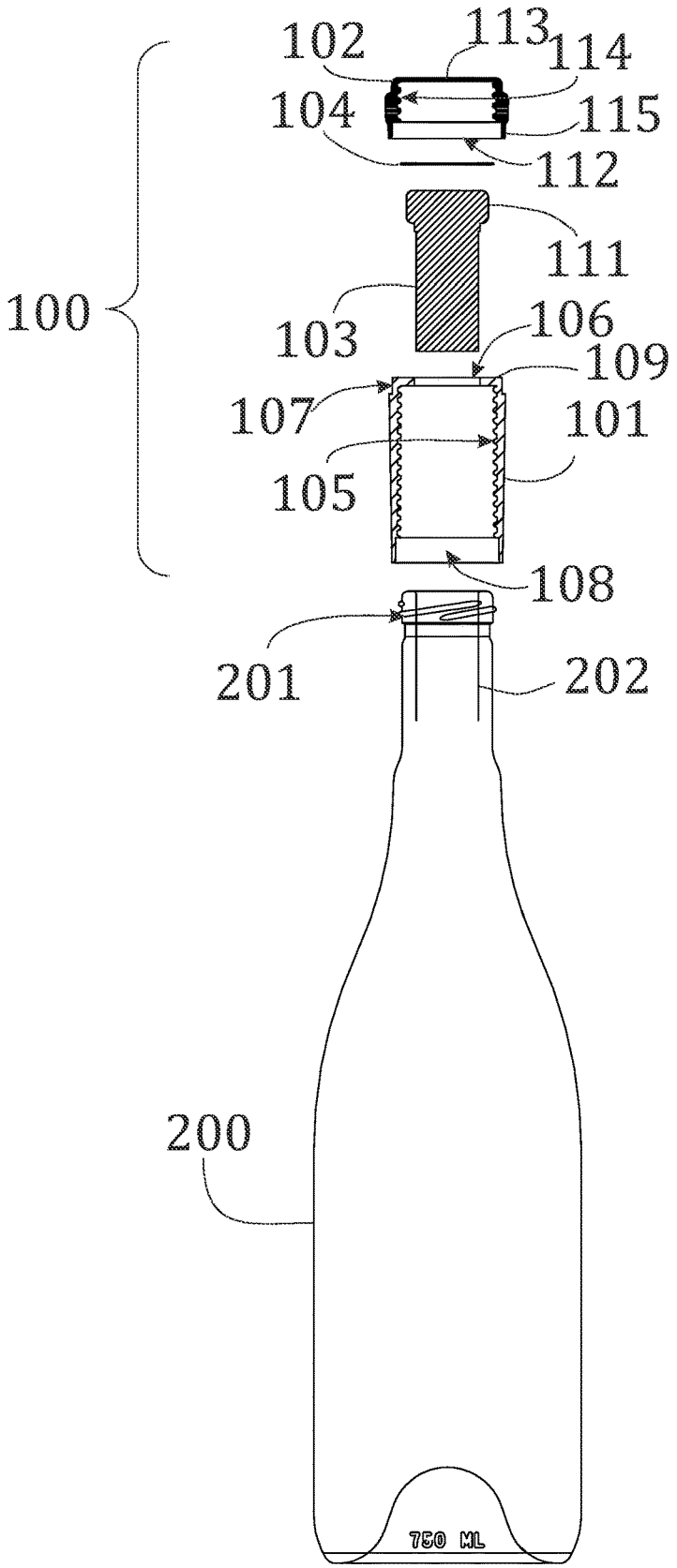
FIG. 4 is an exploded view of the wine bottle closure and opener device of FIG. 1.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide a wine bottle closure and opener device.

It is to be understood that the terminology used herein is for the purpose of describing particular embodiments only and is not intended to be limiting. The terms "a" or "an," as used herein, are defined as to mean "at least one." The term "plurality," as used herein, is defined as two or more. The term "another," as used herein, is defined as at least a second or more. The terms "including" and/or "having," as used herein, are defined as comprising (i.e., open language). The term "providing" is defined herein in its broadest sense, e.g., bringing/coming into physical existence, making available, and/or supplying to someone or something, in whole or in multiple parts at once or over a period of time. These terms generally refer to a range of numbers that one of skill in the art would consider equivalent to the recited values (i.e., having the same function or result). In many instances these terms may include numbers that are rounded to the nearest significant figure.

FIGS. 1-4 are various views of a wine bottle closure and opener device 100 according to an embodiment of the present invention. Referring now to FIGS. 1-4, the wine bottle closure and opener device 100 is illustrated and installed on a wine bottle 200. Advantageously, best seen in FIG. 1, the device's external appearance is similar to a traditional wine bottle and cork closure system as well known in the art. The present invention requires minimal changes to a typical 750 milliliter bottle, and more specifically, male threads 201 are provided on the top portion of the bottle's neck and the usual protruding ring beneath where the threads are added is replaced with a groove. This feature is required for grasping the bottle during the glass manufacturing process.

In one embodiment, the wine bottle closure and opener device 100 comprises a sleeve 101, a resealing cap 102, a cork 103, and gasket 104. In one embodiment, the sleeve 101 comprises an inner surface having female threads 105, a top opening 106 and a bottom opening 108. In the installed position, the bottom opening 108 enables the sleeve 101 to extend down the neck of the bottle 200, wherein the threads 105 are configured to mate with the threads 201 on the neck of the bottle 200. Top opening 106 has a reduced diameter from the outer diameter of sleeve 101 forming rim 109. In some embodiments, the top portion of the sleeve includes a step 107, wherein the step 107 has a reduced diameter compared to the largest diameter portion of the external surface of the sleeve 101, found adjacent and just lower than the step 107. In some embodiments, the sleeve 101 has a slight downward taper from top to bottom. In one embodiment, the cylindrical sleeve 101 is constructed from a high-strength polymer. In another embodiment, the sleeve 101 is constructed from aluminum. It should be understood that the material selection may vary without departing from the scope of the invention, including but not limited to hardwood and hardened wood. Further, the sleeve 101 may be constructed in any color and include labels, insignia, designs, images, or similar marketing materials.

The cork 103 fits snugly within the bottle's opening 202 sealing the wine or other liquid contents within the bottle 200, and preventing oxygen ingress into the bottle. In one embodiment, the resealing cap 102 comprises an opening 112, an enclosed top surface 113, internal female threads 114, and lip 115. In some embodiments, the resealing cap 102 is configured to enclose the top portion of the cork 103 and sit atop the sleeve 101, wherein the lip 115 is engaged with step 107. Gasket 104 is configured to sit underneath the top surface 113 of the resealing cap 102 and is described in further detail below.

Figure 11A:
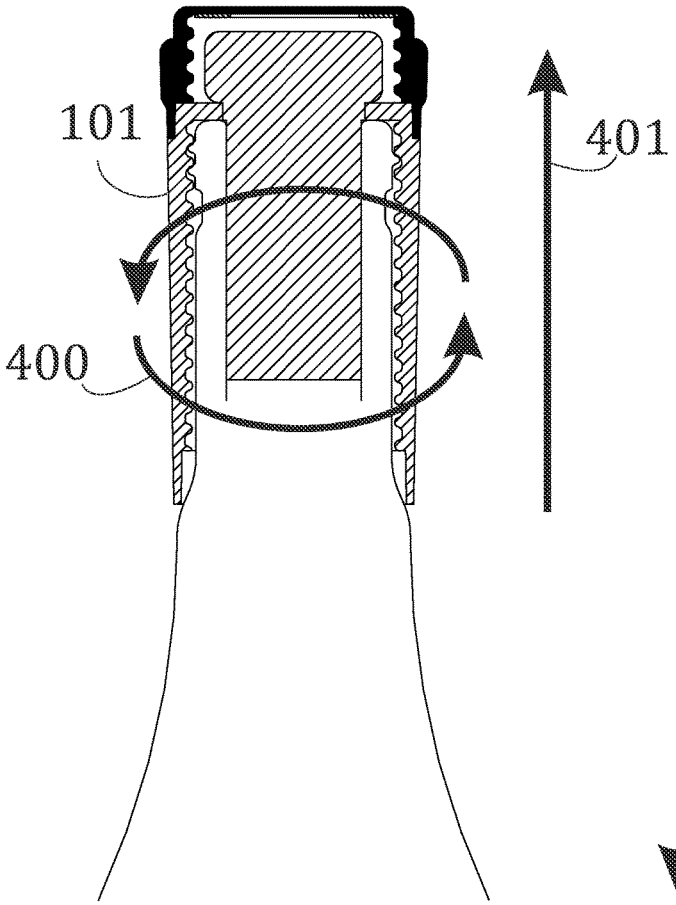
FIGS. 11A-H illustrate the operation of a wine bottle closure and opener device according to an embodiment of the present invention.
Figure 11B:
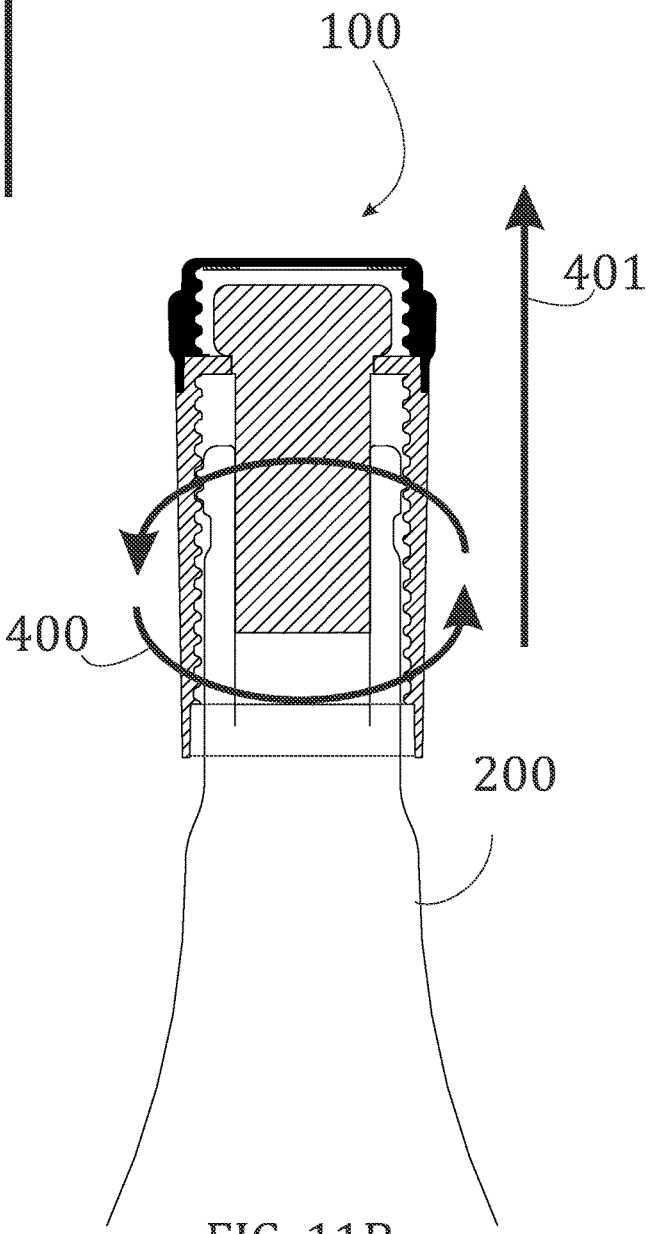
Figure 11C:
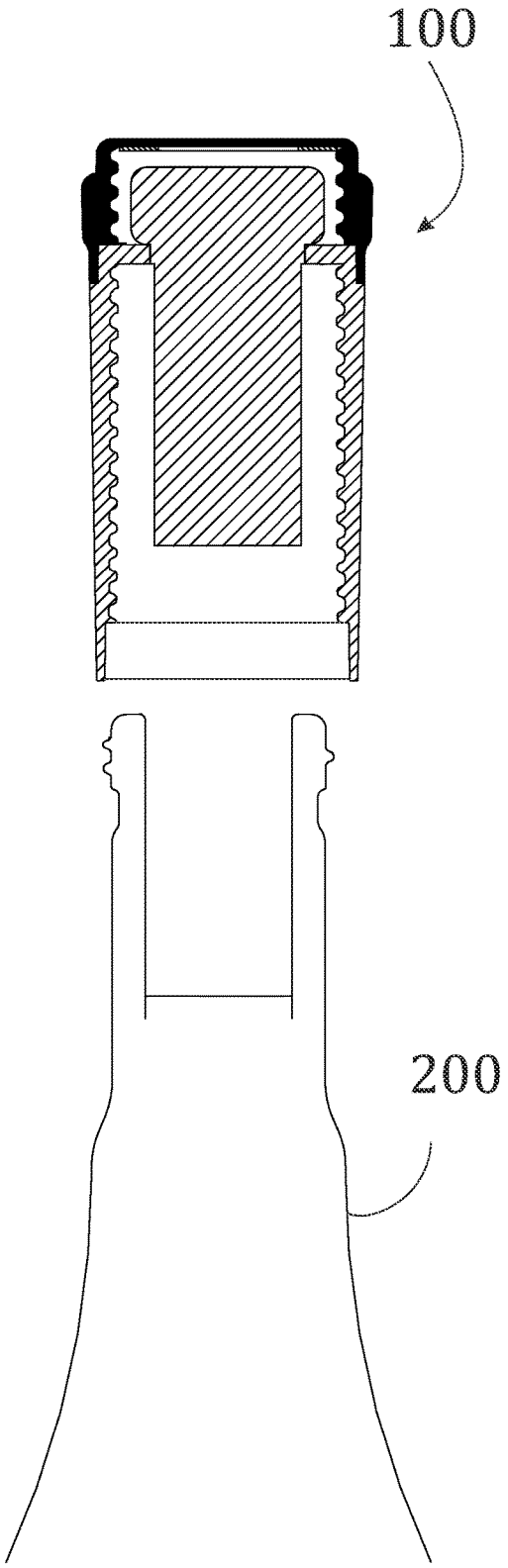
Figure 11D:
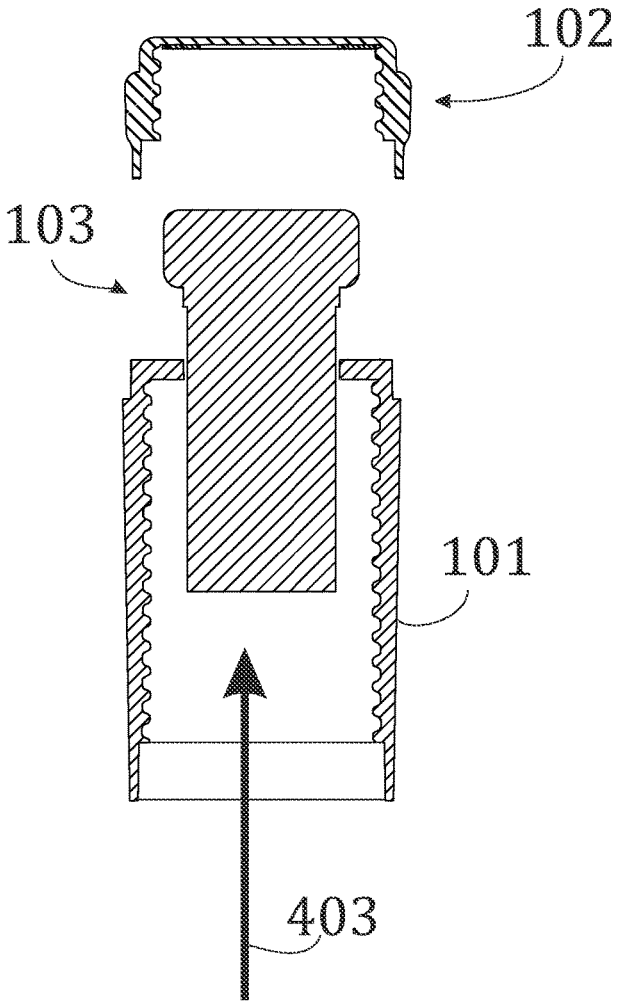
Figure 11E:
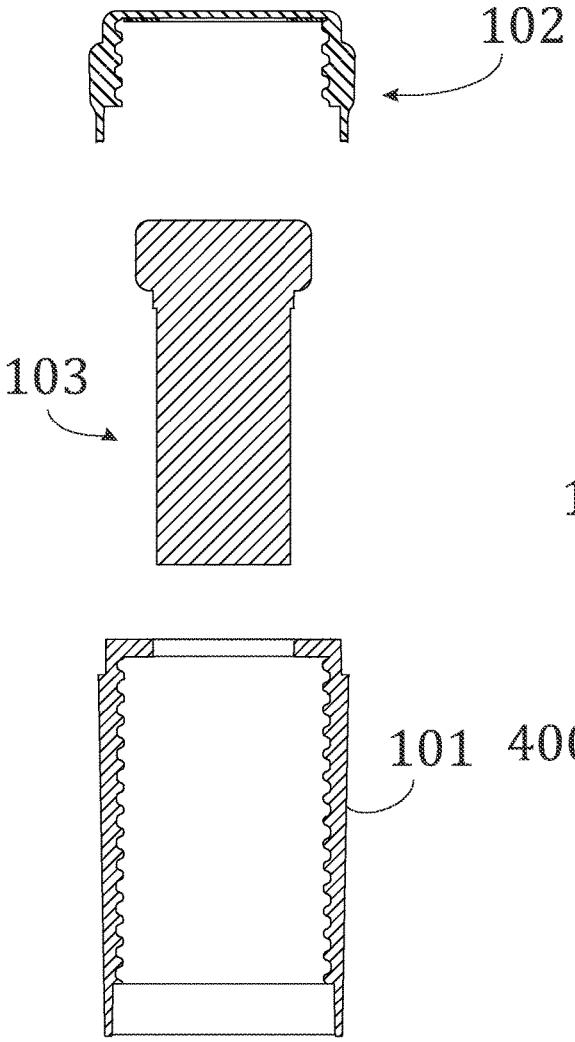
Figure 11F:
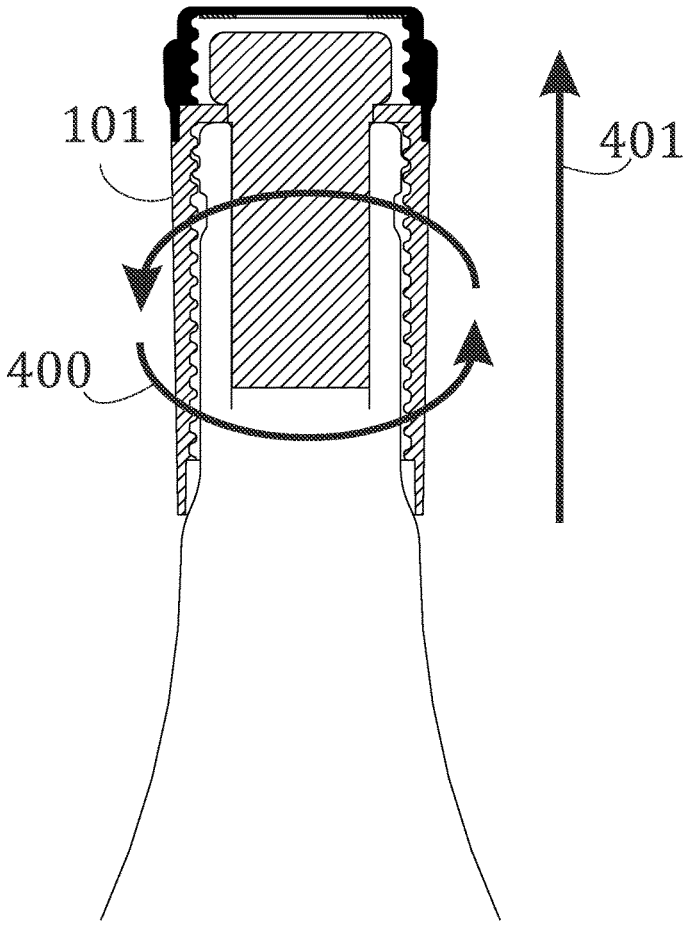
Figure 11G:
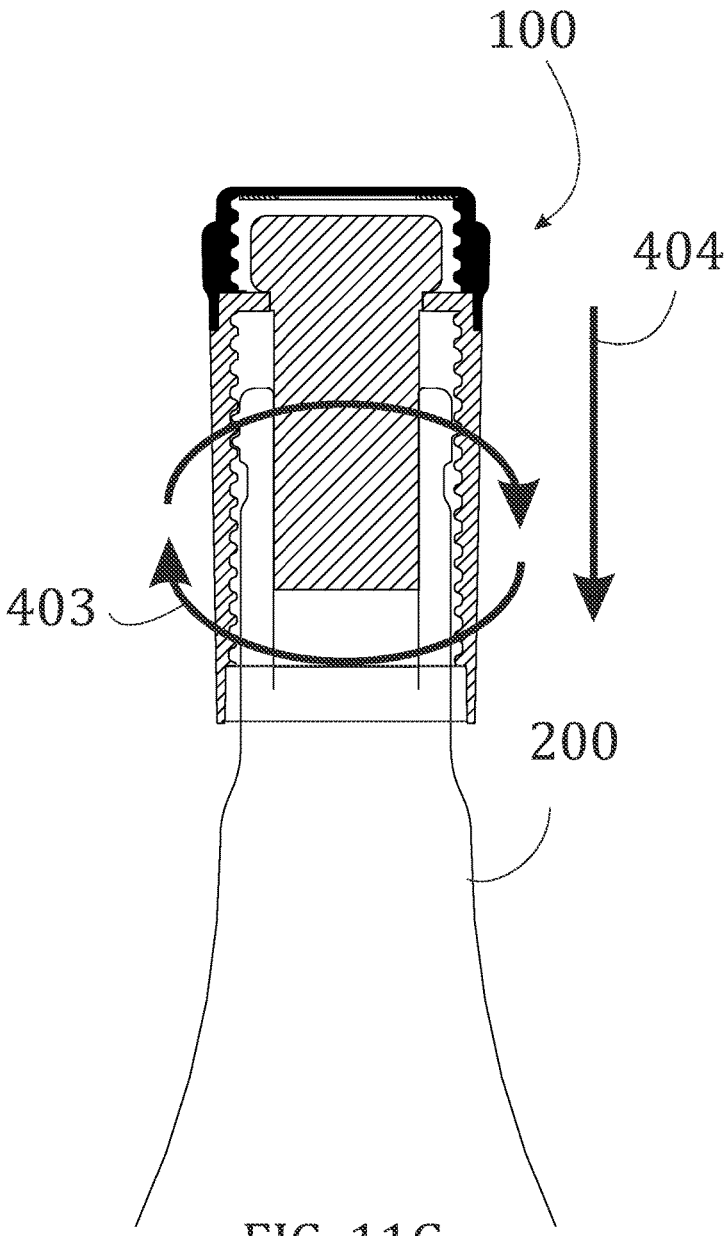
Figure 11H:
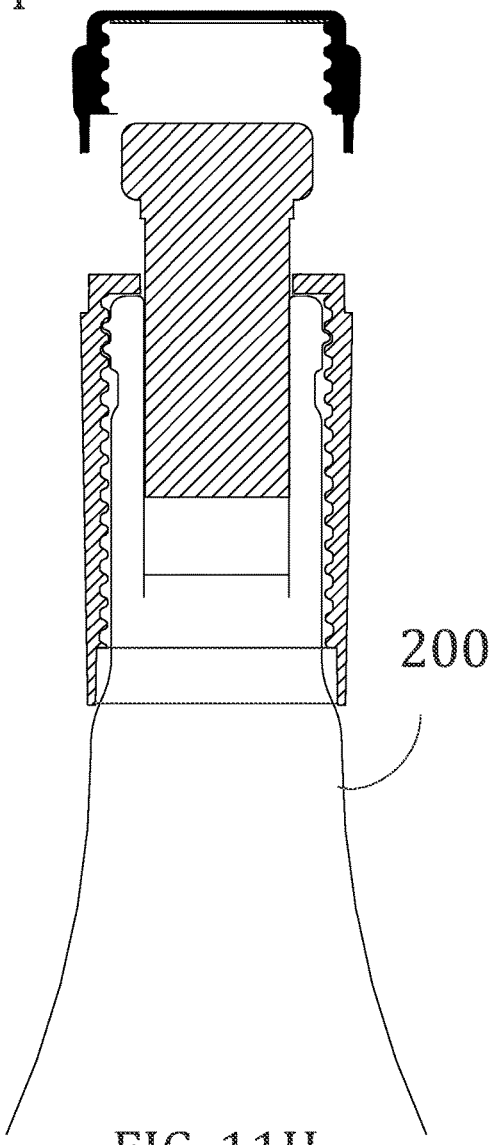
Figure 12:
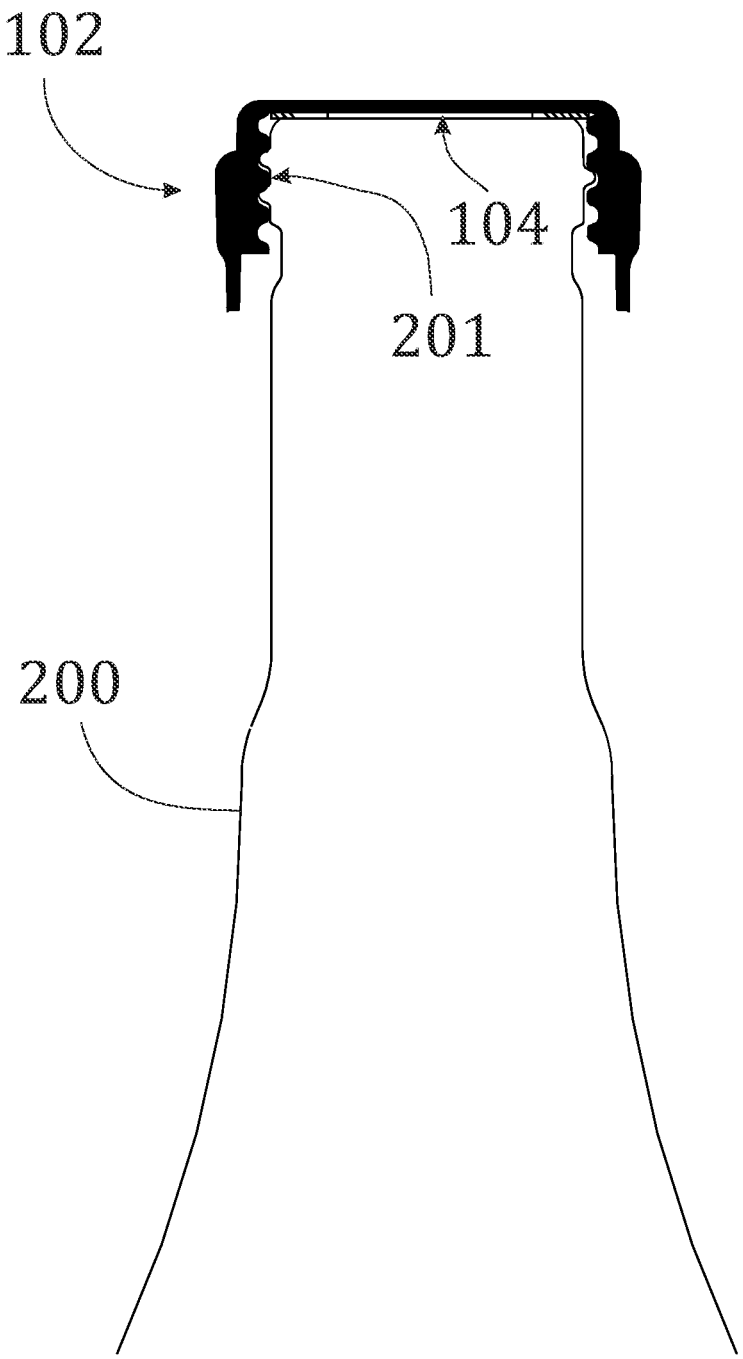
FIG. 12 is a detailed section view of a resealing cap on a wine bottle according to an embodiment of the present invention.

Best seen in FIGS. 11A-11E, during use, for removal, a user is configured to rotate the sleeve 101 counterclockwise 400 which raises the sleeve 101 upwards (in the direction of arrow 401) until the threads of the sleeve are free from the threads provided on the bottle's neck removing the device 100 from the bottle 200 as seen in FIG. 11C. Once the sleeve 101 is fully removed, the cork 103 may be pushed out of the sleeve 101 from underneath 403, which removes the resealing cap 102 from atop the sleeve 101. As an alternative to pushing the sleeve 101 from underneath, via a thumb or finger, the user can reverse the direction of rotation 403 of the sleeve 101 before the sleeve is fully unscrewed from the bottle, lowering sleeve 404 and exposing the cork for removal. (see FIGS. 11F-11H). If desired, the resealing cap 102 may be screwed onto the bottle top 201 as seen in FIG. 12. Gasket 104 ensures a liquid tight seal is provided and the contents of the resealed bottle do not leak during storage or transport.

Figure 5:
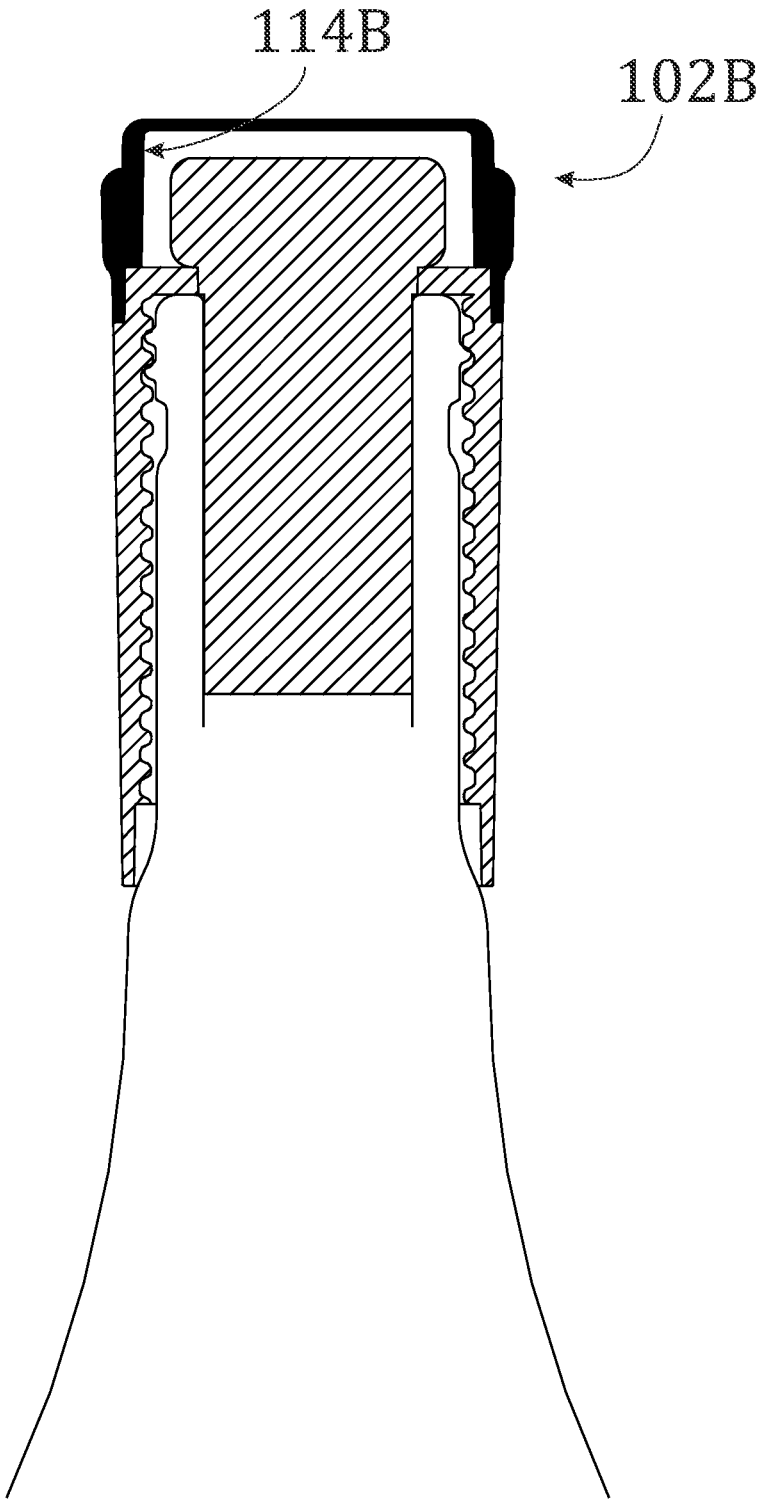
FIG. 5 is a detailed view of a wine bottle closure and opener device having an alternative cap according to an embodiment of the present invention.
Figure 6:
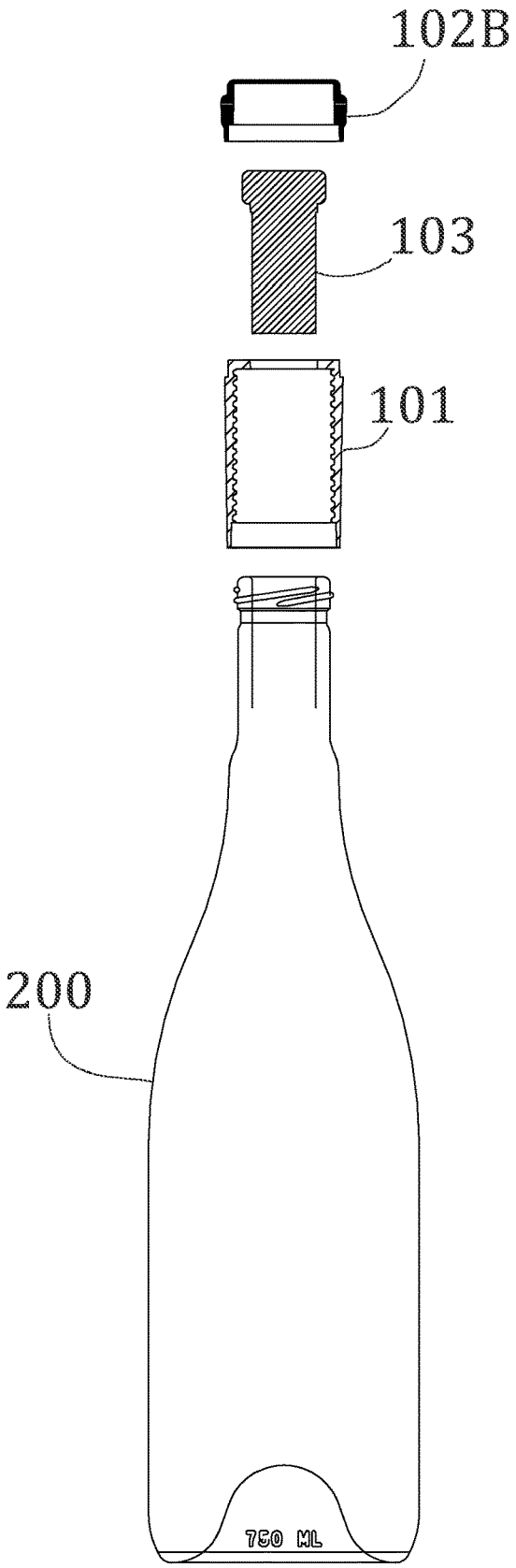
FIG. 6 is an exploded view of the wine bottle closure and opener device of FIG. 5.
Figure 7:
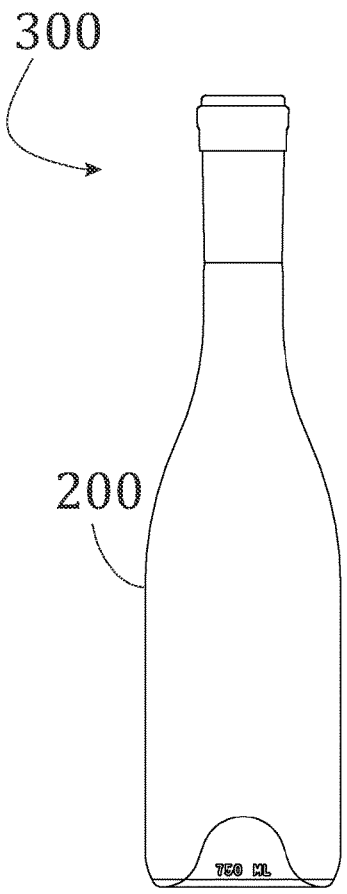
FIG. 7 is a front perspective view of an alternative wine bottle closure and opener device intended for sparking wine according to an embodiment of the present invention.
Figure 8:
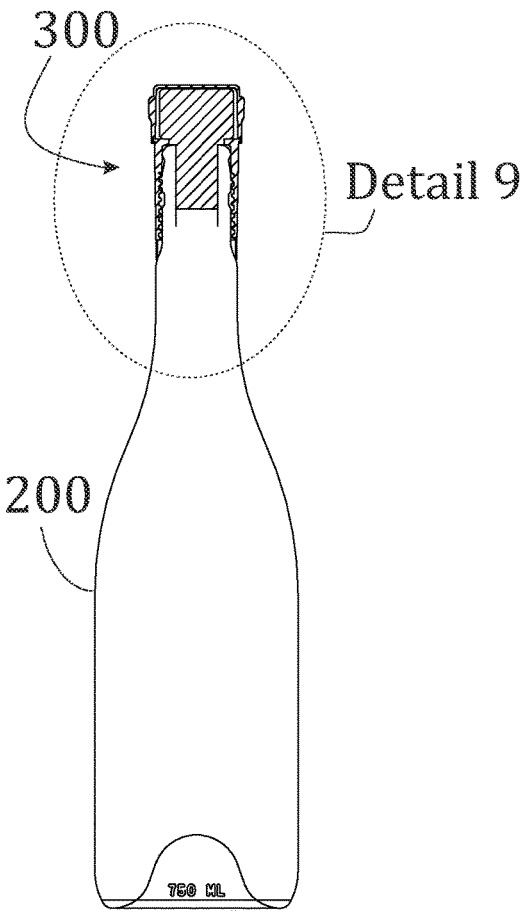
FIG. 8 is a sectional view of FIG. 7.
Figure 9:
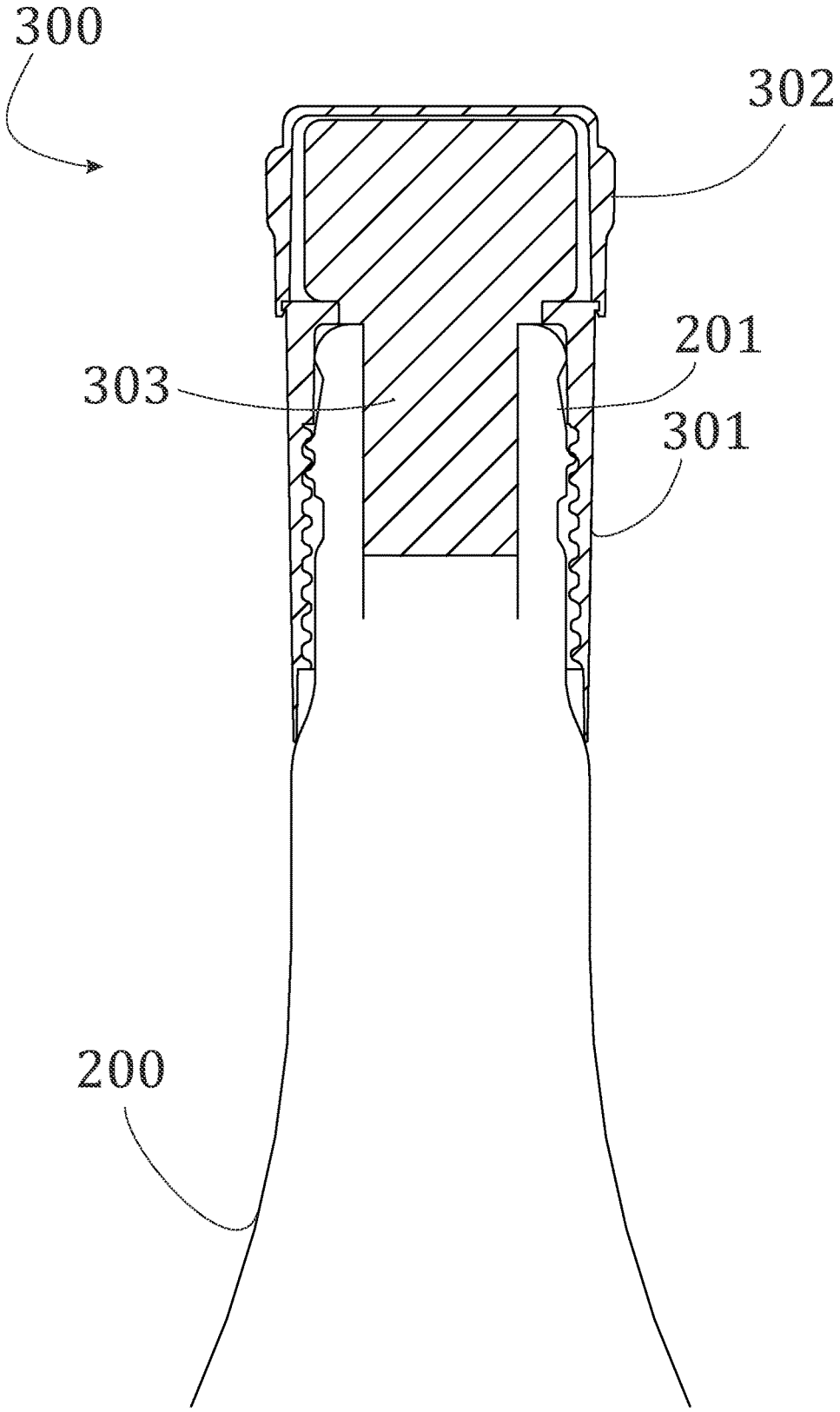
FIG. 9 is a detailed view of FIG. 8.
Figure 10:
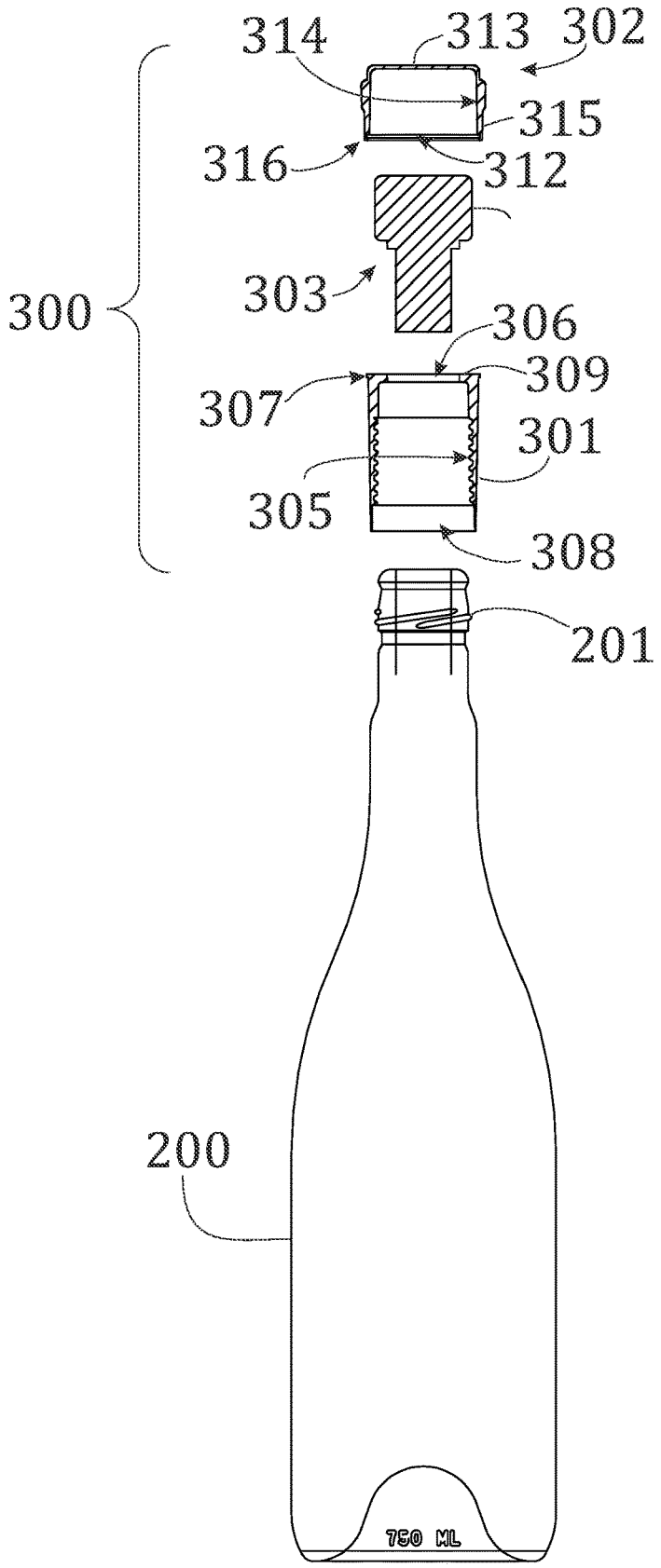
FIG. 10 is an exploded view of the wine bottle closure and opener device of FIG. 7.

FIGS. 5-6 are various views of a wine bottle closure and opener device having an alternative cap 102B according to an embodiment of the present invention. Referring now to FIGS. 5-6, the alternative cap 102B is similar to the resealing cap in structure, however, the alternative cap 102B includes a smooth inner surface 114B and it is not intended to be used after removal. No gasket is provided in this embodiment. The function and operation of removal as described above in FIGS. 11A-B is unchanged for this embodiment.

FIGS. 7-10 are various views of an alternative wine bottle closure and opener device 300 for sparkling wine according to an embodiment of the present invention. Referring now to FIGS. 7-10, the wine bottle closure and opener device 300 is illustrated. In one embodiment, the device 300 comprises sleeve 301, cap 302, and cork 303. Similar to the previously described embodiments, the sleeve 301 comprises an inner surface having female threads 305, a top opening 306 and a bottom opening 308. In one embodiment, a top portion of the sleeve 301 includes flange 307 and rim 309. The cork 303 fits snugly within the bottle's opening 202 sealing the wine or other liquid contents within the bottle 200, and preventing oxygen ingress into the bottle, via compression as well known in the art. In one embodiment, the cap 302 comprises an opening 312, an enclosed top surface 313, and lip 315. In some embodiments, the lip 115 includes a hooked surface 316. In some embodiments, the cap 302 is configured to enclose the a top portion of the cork 303 and sit atop the sleeve 301, wherein the lip 315 and more specifically the hooked surface 316 is secured and clipped to flange 307 preventing the cork from an explosive exit, due to pressure in the bottle, when friction between the cork and glass inside the neck is reduced as the cork is lifted. Otherwise, the removal and operation is similar to what is described above. The cap 302 is also configured to retain the cork, not only during intentional opening, but also to avoid pressure inside the bottle from pushing the cork upward and out of the bottle, without any assistance from the consumer. Sufficient pressure to cause this can result from agitation of the bottle and from increased ambient temperature. Advantageously, the cork is not fully released until the pressure has been released from the bottle, preventing injury to the user.

Figure 13:
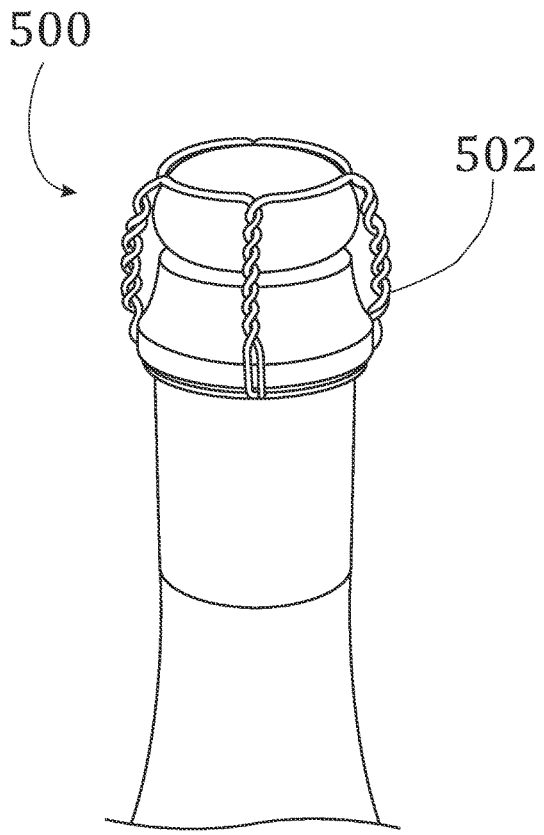
FIG. 13 is a detailed perspective view showing a second alternative wine bottle closure and opener device intended for sparking wine according to an embodiment of the present invention.
Figure 14:
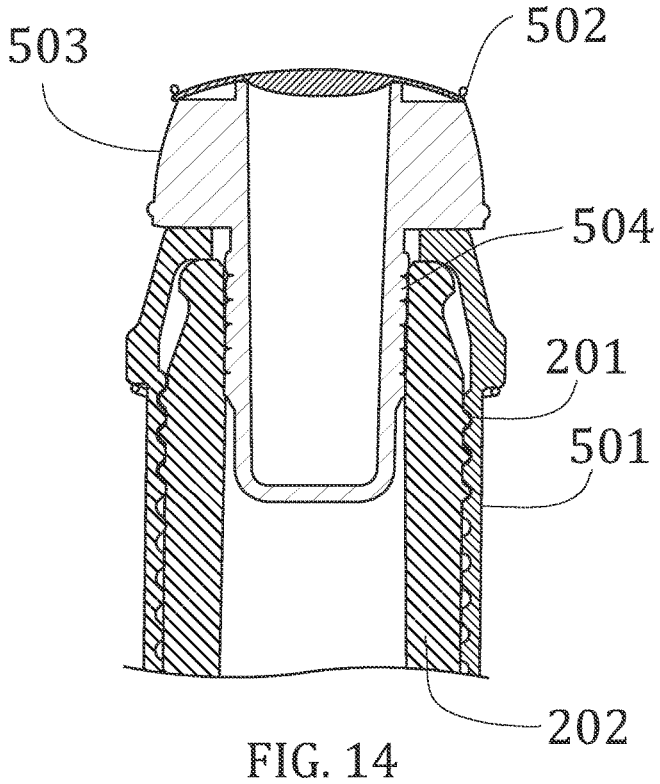
FIG. 14 is a sectional view of FIG. 13.
Figure 15:
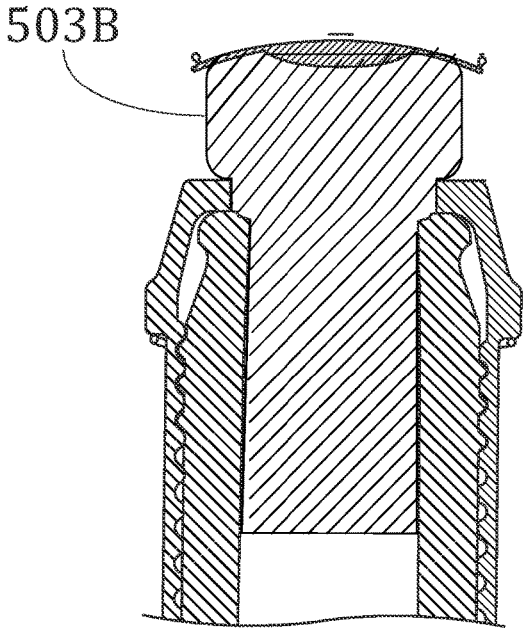
FIG. 15 is a sectional view of the second alternative wine bottle closure and opener device with an alternative cork according to an embodiment of the present invention.

FIGS. 13-14 are various views of a second alternative wine bottle closure and opener device 500 intended for sparkling wine according to an embodiment of the present invention. Referring now to FIGS. 13-14, the advantage of closure device 500 is the appearance resembling a traditional sparkling wine closure known in the art. In one embodiment, the closure device 500 comprises sleeve 501, wirehood or wire cage 502, and cork 503. The sleeve 501 has internal threads similar to the previously described embodiments, wherein the threads are configured to engage and mate with the threaded top portion 201 of the bottle. During operation, the sleeve 501 is rotated counterclockwise which is configured to push the cork 503 out of the bottle. The wirehood 502 is left in place during removal. Advantageously, the pressure in the bottle is released before the sleeve 501 is fully uncrewed from the bottle top preventing an explosive cork exit. In one embodiment, the cork 503 is constructed from plastic and includes protrusions 504 aiding in securing the cork 503 within the bottle's opening 202 and to form a liquid and air seal such that the sparkling wine is retained and sealed within the bottle. In other embodiments, the cork 503B is constructed from natural or synthetic cork materials without protrusions as shown in FIG. 15.

Figure 16:
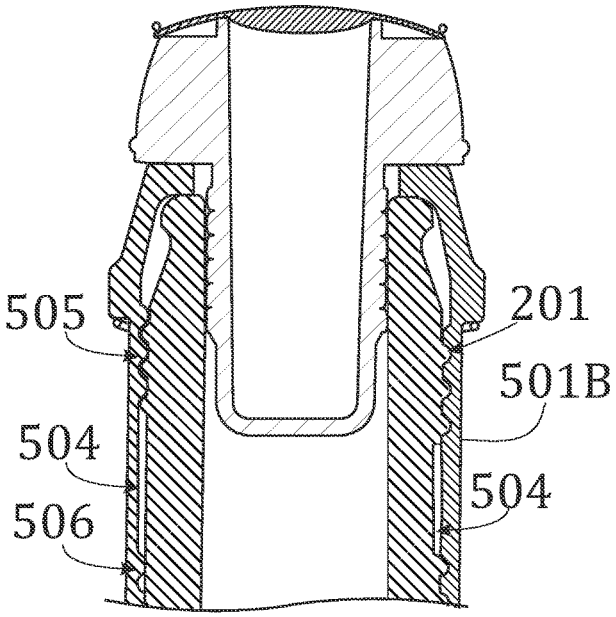
FIG. 16 is a sectional view of the second alternative wine bottle closure and opener device with an alternative sleeve according to an embodiment of the present invention.

Best seen in FIG. 16, in some embodiments, the sleeve 501B is modified to include a thread gap 504 providing upper threads 505 and lower threads 506, which allows the cork to accelerate upward a limited distance due to pressure in the bottle once the upper threads 505 clear the threaded top portion 201 of the bottle. However, the lower threads 506 prevent the cork from fully exiting the bottle neck, preventing an explosive cork exit. Advantageously, this thread gap 504 produces the desired traditional "pop" sound associated with opening a bottle of sparkling wine. It should be understood that the axial length of the thread gap 504 may vary. It should be noted that more lower threads 506 may be provided than illustrated, as a sufficient number of lower threads are required to ensure the sleeve 501B is secured to the bottle until the sleeve 501B is fully manually unscrewed from the threads 201 provided on the bottle's neck.

Figure 17:
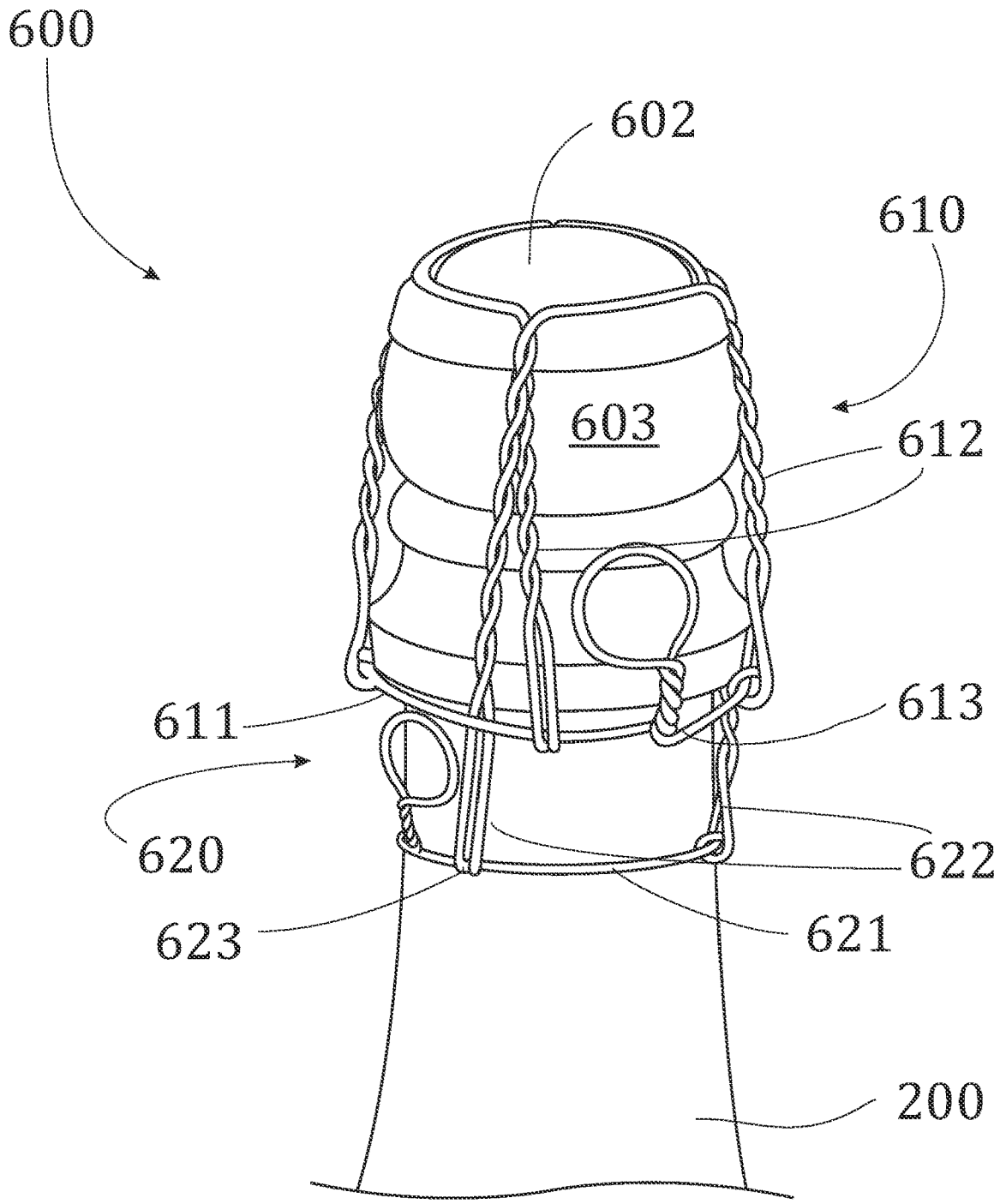
FIG. 17 is a perspective view of a double muselet provided to prevent an explosive cork exit when opening a bottle of sparkling wine according to an embodiment of the present invention.

Referring now to FIG. 17, as an alternative to the thread gap, a double muselet (double wire cage) 600 may be provided to prevent an explosive cork exit when opening a bottle of sparkling wine. More specifically, the double muselet 600 comprises a first muselet 610 and a second muselet 620. Each muselet comprising a belt 611/621 and a cage 612/622, wherein each cage includes at least two wires assembled via twisting as well known in the art. Each cage including eyelets 613/623 rolled towards the inside or outside so that the belt 611/621 can be fitted through them. In some embodiments, a wirehood cap 602 is provided above the top of cork 603 within the cages 612/622. In one embodiment, each muselet is constructed from soft galvanized or lacquered steel wire.

In one embodiment, the first muselet 610 is shorter than the second muselet 620. During assembly, the second muselet is installed on the bottle 200 first. The belt 621 of the second muselet is tied looser than the belt 611 of the first muselet. Belt 611 of the first muselet 610 is applied on top of the cage 622 of the second muselet 620, wherein the position of the belt 611 is tightly lodged underneath the producing glass ring around the bottle neck as typically installed for a standard muselet.

During use, when the consumer is ready to consume the sparkling wine, the shorter wire cage 612 of the first muselet can be removed as usual or just loosened. Then the cork 603 with remaining longer wire cage 622 in place can be manipulated upward as usual until the pressure explosively forces the cork 603 further upward until the belt 621 on the wire cage 622 of the second muselet 620 lodges beneath the protruding glass ring—the same ring that the belt 611 on the shorter wire cage 612 was lodged beneath before being manually loosened. The wire cage 222 is able to move upward because it has not been tied too tightly to the bottle. This longer cage of the second museleet is long enough to allow the cork to fully exit the bottle and produce the usual pop sound, but it keeps the cork anchored to the bottle so that it cannot fly away. In one embodiment, the distance between the upper 611 and lower 612 wire belts is set equal to the length of the cork inside the bottle neck plus an additional amount sufficient to produce the pop sound as the cork exits the neck. Once the pressure has been released, the longer cage can be removed in the same manner that traditional wire cages are removed by loosening the belt, in order to fully remove the cage and cork from engagement with the bottle. It should be understood that each wire cage of the first and second muselet includes three to four arms, and some arms may not be visible in the illustrated example of FIG. 17. In some embodiments, the loop used to loosen the second muselet 620 is removed after installation during manufacturing assembly (e.g. bottling line) preventing users from mistakenly loosening the second muselet prior to the first muselet 610 which may be a safety issue. It should be understood that other solutions may be provided to ensure proper use carried out by the user during use.

Figure 18:
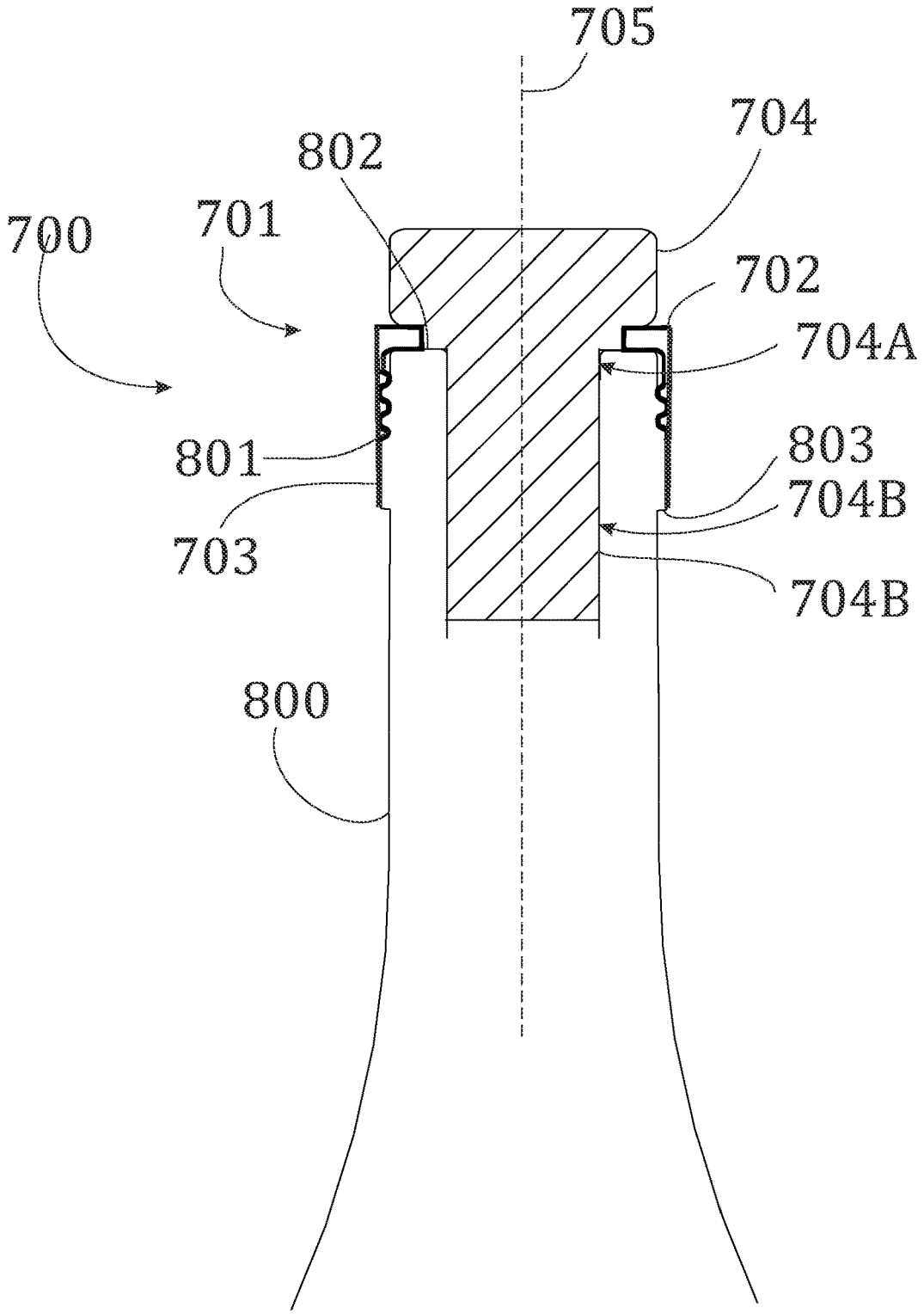
FIG. 18 is a sectional view of the third alternative wine bottle closure and opener device with an alternative cork according to an embodiment of the present invention.

FIG. 18 is a sectional view of the third alternative wine bottle closure and opener device with an alternative cork according to an embodiment of the present invention. Referring now to FIG. 18, third alternative wine bottle closure and opener device 700 comprises a threaded sleeve 701 having a circumferential lip 702 directed radially inward at a top portion of the threaded sleeve, wherein the circumferential lip is configured to rest on the bottle's top 802 of a standard screw bottle 800 having threads 801. The standard screw bottle is normally provided with a screwcap (not illustrated) as well known in the art. Advantageously, device 700 is configured to be compatible with this type of bottle.

In one embodiment, the threaded sleeve 701 includes a skirt 703 minimally extending from the lower threads 704 of the threaded sleeve. In one embodiment, the skirt 703 extends approximately the distance to the lower edge of protruding glass band 803 of the bottle, but not further downward, which reduces the chance of injury from the lower edge of the skirt. In one embodiment, the threaded sleeve is constructed from aluminum with adequate strength to operate the device. In one embodiment, during use, a user may unscrew the threaded sleeve counter-clockwise which pushes the cork 704 upward, similar in principle to the other embodiments described. However, in this embodiment, the cork is moved upward only approximately 4 mm in distance (as determined by the axial length of threads in the standard screw bottle) by twisting the threaded sleeve 701, after which the cork may be fully removed by the user by pulling upward on the threaded sleeve 701 and (the bulb of) cork 704 combination. To accomplish this, the cork is tapered such that the diameter of the upper portion 704A of the cork 704 is greater than the diameter of the lower portion 704B. In other embodiments, the upper portion of the cork 704A is waxed to improve the seal, as well known in the art, between this upper portion and the inside of the adjacent portion of the bottle neck. Although this increases the friction, as well known in the art, between cork and glass, requiring more axial force to lift the cork, the mechanical advantage determined by the pitch of the threads 801 can enable the consumer to easily produce the required torque while untwisting the sleeve. In some embodiments, the entire cork may be coated with wax, and the upper and lower portions (704A/704B) of the cork may have different diameters to control the axial force required at different stages of cork removal, wherein the upper portion has a diameter that is larger than the lower portion of the cork.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternative embodiments are contemplated, and can be made without departing from the spirit and scope of the invention.

It should further be noted that throughout the entire disclosure, the labels such as left, right, front, back, top, bottom, forward, reverse, clockwise, counterclockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, references to "first," "second," "third," and etc. members throughout the disclosure (and in particular, claims) are not used to show a serial or numerical limitation but instead are used to distinguish or identify the various members of the group.

What is claimed is:

1. A bottle closure and opener device for use on a wine bottle comprising:

a sleeve having a top side, a bottom side, an outer surface, and an inner surface, the top side having a first opening, the bottom side having a second opening, and the inner surface including internal threads, wherein the internal threads are configured to mate with external threads on a top portion of the wine bottle, wherein the sleeve encompasses the wine bottle's neck below the external threads;

a cork positioned within the first opening of the sleeve and positioned within and directly against an inner surface of the wine bottle's neck to seal a liquid within the wine bottle and to seal oxygen from entering the bottle; and, wherein the cork is configured to be removed from the wine bottle's opening by unscrewing the sleeve from the top portion of the wine bottle, thereby pushing against an underside of a top portion of the cork that protrudes beyond the wine bottle's neck.

2. The bottle closure and opener device of claim 1, further comprising a cap enclosing a portion of the cork and engaged with an upper portion of the sleeve.

3. The bottle closure and opener device of claim 2, wherein the cap is a resealing cap having internal threads configured to mate with the external threads on the top portion of the wine bottle such that the wine bottle may be resealed.

4. The bottle closure and opener device of claim 1, wherein the second opening of the sleeve is configured to receive the top portion of the wine bottle enabling the sleeve to encompass the wine bottle's neck.

5. The bottle closure and opener device of claim 1, wherein the cork is constructed from a natural and/or synthetic material.

6. The bottle closure and opener device of claim 1, wherein the sleeve is constructed from a high-strength polymer, tin, aluminum, hardwood, or hardened wood.

7. The bottle closure and opener device of claim 1, wherein the liquid within the wine bottle is still wine or sparkling wine.

* * * * *